US011270836B2

(12) United States Patent
Park et al.

(10) Patent No.: US 11,270,836 B2
(45) Date of Patent: Mar. 8, 2022

(54) INDUCTOR

(71) Applicant: SAMSUNG ELECTRO-MECHANICS CO., LTD., Suwon-si (KR)

(72) Inventors: Sang Soo Park, Suwon-si (KR); Hwi Dae Kim, Suwon-si (KR); Young Ghyu Ahn, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 163 days.

(21) Appl. No.: 16/189,409

(22) Filed: Nov. 13, 2018

(65) Prior Publication Data

US 2019/0333689 A1 Oct. 31, 2019

(30) Foreign Application Priority Data

Apr. 26, 2018 (KR) ..... 10-2018-0048422

(51) Int. Cl.
*H01F 17/00* (2006.01)
*H01F 27/29* (2006.01)
*H01F 27/32* (2006.01)

(52) U.S. Cl.
CPC ..... *H01F 27/292* (2013.01); *H01F 17/0013* (2013.01); *H01F 27/32* (2013.01)

(58) Field of Classification Search
CPC ..... H01F 17/0006; H01F 17/0013; H01F 27/2804; H01F 27/292; H01F 27/32; H01F 27/323; H01F 2027/2809
(Continued)

(56) References Cited

U.S. PATENT DOCUMENTS 6,218,925 B1 4/2001 Iwao
2008/0157913 A1 7/2008 Kim
(Continued)

FOREIGN PATENT DOCUMENTS

JP 11-97244 A 4/1999
JP 11097244 A * 4/1999
(Continued)

OTHER PUBLICATIONS

Office Action issued in corresponding Korean Application No. 10-2018-0048422, dated May 20, 2019.
(Continued)

*Primary Examiner* — Tszfung J Chan
(74) *Attorney, Agent, or Firm* — Morgan, Lewis & Bockius LLP

(57) ABSTRACT

An inductor includes a body in which a plurality of insulating layers on which a plurality of coil patterns are respectively disposed are stacked, and first and second external electrodes disposed on an external surface of the body. The plurality of coil patterns are connected to each other by coil connecting portions and opposing ends thereof are connected to the first and second external electrodes through coil lead portions, respectively, to form a coil. The plurality of coil patterns include coil patterns disposed on outermost sides of the body and coil patterns disposed on an inner side thereof. The coil patterns arranged on the inner side are connected in parallel. At least one of gaps between the coil patterns arranged on the inner side is greater than a gap between other remaining coil patterns.

19 Claims, 3 Drawing Sheets

(58) Field of Classification Search
USPC ..... 336/200, 232
See application file for complete search history.

(56) References Cited

U.S. PATENT DOCUMENTS

| | | | | |
|---|---|---|---|---|
| 2010/0109829 | A1* | 5/2010 | Sugiyama | H01F 17/0013 336/200 |
| 2013/0015937 | A1* | 1/2013 | Seko | H01F 41/043 336/200 |
| 2013/0200980 | A1* | 8/2013 | Yokoyama | H01F 17/0013 336/200 |
| 2014/0253277 | A1* | 9/2014 | Takezawa | H01F 17/0013 336/200 |
| 2015/0371754 | A1* | 12/2015 | Im | H01F 17/0013 174/260 |
| 2017/0133142 | A1* | 5/2017 | Park | H03H 1/0007 |
| 2018/0012696 | A1 | 1/2018 | Lee et al. | |
| 2018/0012700 | A1 | 1/2018 | Lee et al. | |

FOREIGN PATENT DOCUMENTS

| | | | | | |
|---|---|---|---|---|---|
| JP | 11-260644 | A | | 9/1999 | |
| JP | 2000-58324 | A | | 2/2000 | |
| JP | 2001-217126 | A | | 8/2001 | |
| JP | 2001217126 | A | * | 8/2001 | |
| JP | 2002367833 | A | * | 12/2002 | |
| JP | 2005-123450 | A | | 5/2005 | |
| JP | 2009-044030 | A | | 2/2009 | |
| JP | 2009-94149 | A | | 4/2009 | |
| JP | 2010-109116 | A | | 5/2010 | |
| JP | 2013-45809 | A | | 3/2013 | |
| JP | 2013-162101 | A | | 8/2013 | |
| JP | 2014-175383 | A | | 9/2014 | |
| JP | 2014175383 | A | * | 9/2014 | H01F 17/0013 |
| KR | 10-0869741 | B1 | | 11/2008 | |
| KR | 10-2012-0031754 | A | | 4/2012 | |
| KR | 10-2018-0006246 | A | | 1/2018 | |

OTHER PUBLICATIONS

Office Action issued in corresponding Japanese Application No. 2018-215121, dated Apr. 2, 2019.

Office Action issued in corresponding Japanese Patent Application No. 2018-215121 dated Sep. 17, 2019, with English translation.

* cited by examiner

INDUCTOR

CROSS-REFERENCE TO RELATED APPLICATION

This application claims benefit of priority to Korean Patent Application No. 10-2018-0048422 filed on Apr. 26, 2018 in the Korean Intellectual Property Office, the disclosure of which is incorporated herein by reference in its entirety.

TECHNICAL FIELD

The present disclosure relates to an inductor.

BACKGROUND

Recently, smartphones have been implemented with the ability to use many frequency bands due to the application of multiband long term evolution (LTE). As a result, high frequency inductors are largely used as impedance matching circuits in signal transmission and reception RF systems. The high frequency inductors are required to have a smaller size and higher capacity. In addition, high frequency inductors have a high self-resonant frequency (SRF) of a high frequency band and low resistivity, and thus, are required to be used at a frequency of 100 MHz or higher. Also, a high Q characteristic is required to reduce loss at a frequency being used.

In order to have such high Q characteristics, characteristics of a material forming a body of an inductor make a greatest influence. However, even when the same material is used, the Q value may vary according to shapes of an inductor coil, and thus, a method for obtaining higher Q characteristics by optimizing the shape of the coil of the inductor is required.

SUMMARY

An aspect of the present disclosure may provide an inductor having high Q characteristics.

According to an aspect of the present disclosure, an inductor may include: a body in which a plurality of insulating layers on which a plurality of coil patterns are respectively disposed are stacked; and first and second external electrodes disposed on an external surface of the body. The plurality of coil patterns may be connected to each other by coil connecting portions and opposing ends thereof may be connected to the first and second external electrodes through coil lead portions, respectively, to form a coil. The plurality of coil patterns may include coil patterns arranged on outermost sides of the body and coil patterns disposed on an inner side thereof. The coil patterns arranged on the inner side may be connected in parallel. At least one of gaps between the coil patterns arranged on the inner side may be greater than a gap between other remaining coil patterns.

According to another aspect of the present disclosure, an inductor may include: a body in which a plurality of insulating layers on which a plurality of coil patterns are respectively disposed are stacked; and first and second external electrodes disposed on an external surface of the body. The plurality of coil patterns may be connected to each other by coil connecting portions and opposing ends thereof may be connected to the first and second external electrodes through coil lead portions, respectively, to form a coil. The plurality of coil patterns may include coil patterns arranged on outermost sides of the body and coil patterns disposed on an inner side thereof. The coil patterns arranged on the inner side may be connected in parallel. A dummy insulating layer without a coil pattern may be disposed between two of the coil patterns arranged on the inner side.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments in the present disclosure will be described in detail with reference to the accompanying drawings.

Figure 1:
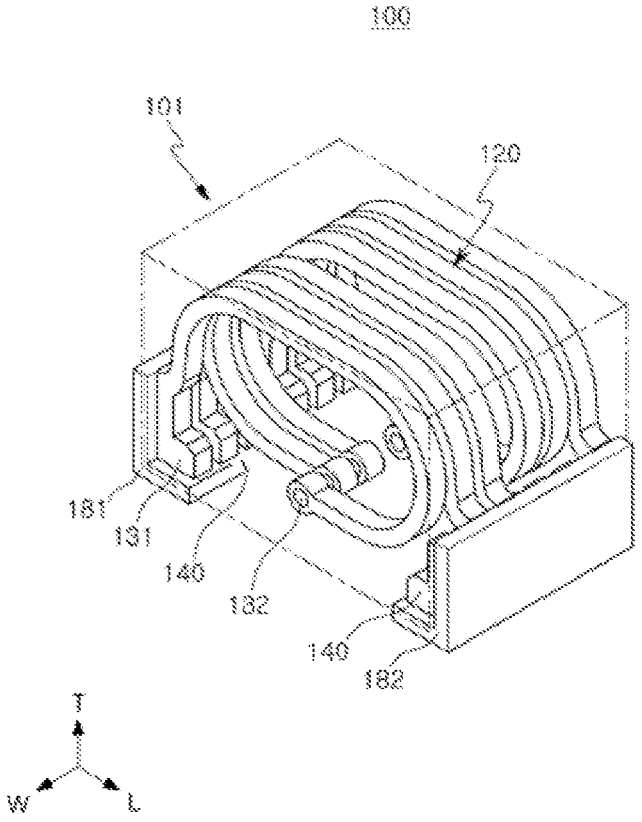
FIG. 1 is a schematic perspective view of an inductor according to an exemplary embodiment in the present disclosure.
Figure 2:
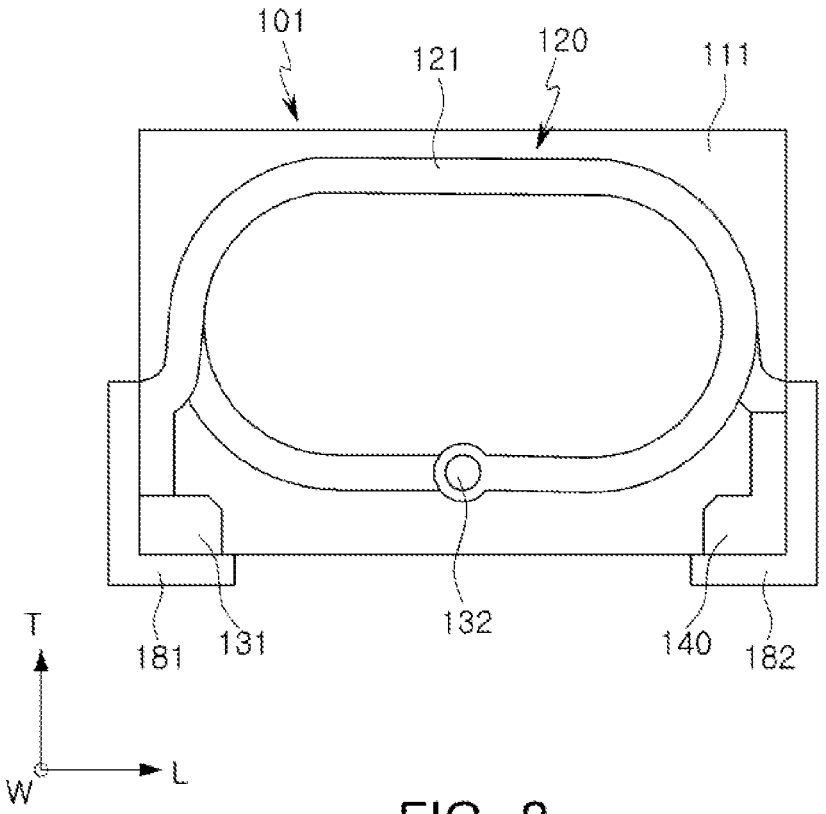
FIG. 2 is a schematic front view of the inductor of FIG. 1.
Figure 3:
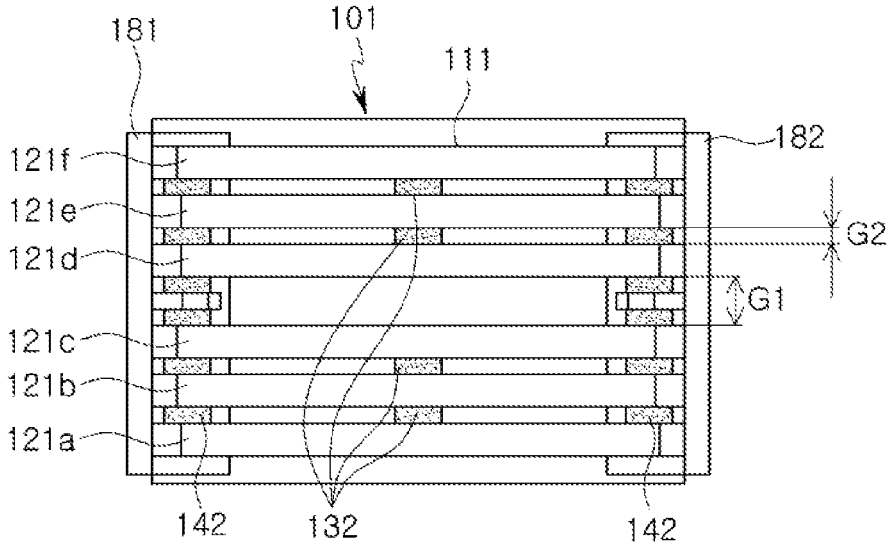
FIG. 3 is a schematic plan view of the inductor of FIG. 1.

FIG. 1 is a schematic perspective view of an inductor according to an exemplary embodiment in the present disclosure, FIG. 2 is a schematic front view of the inductor of FIG. 1, and FIG. 3 is a schematic plan view of the inductor of FIG. 1.

Figure 4:
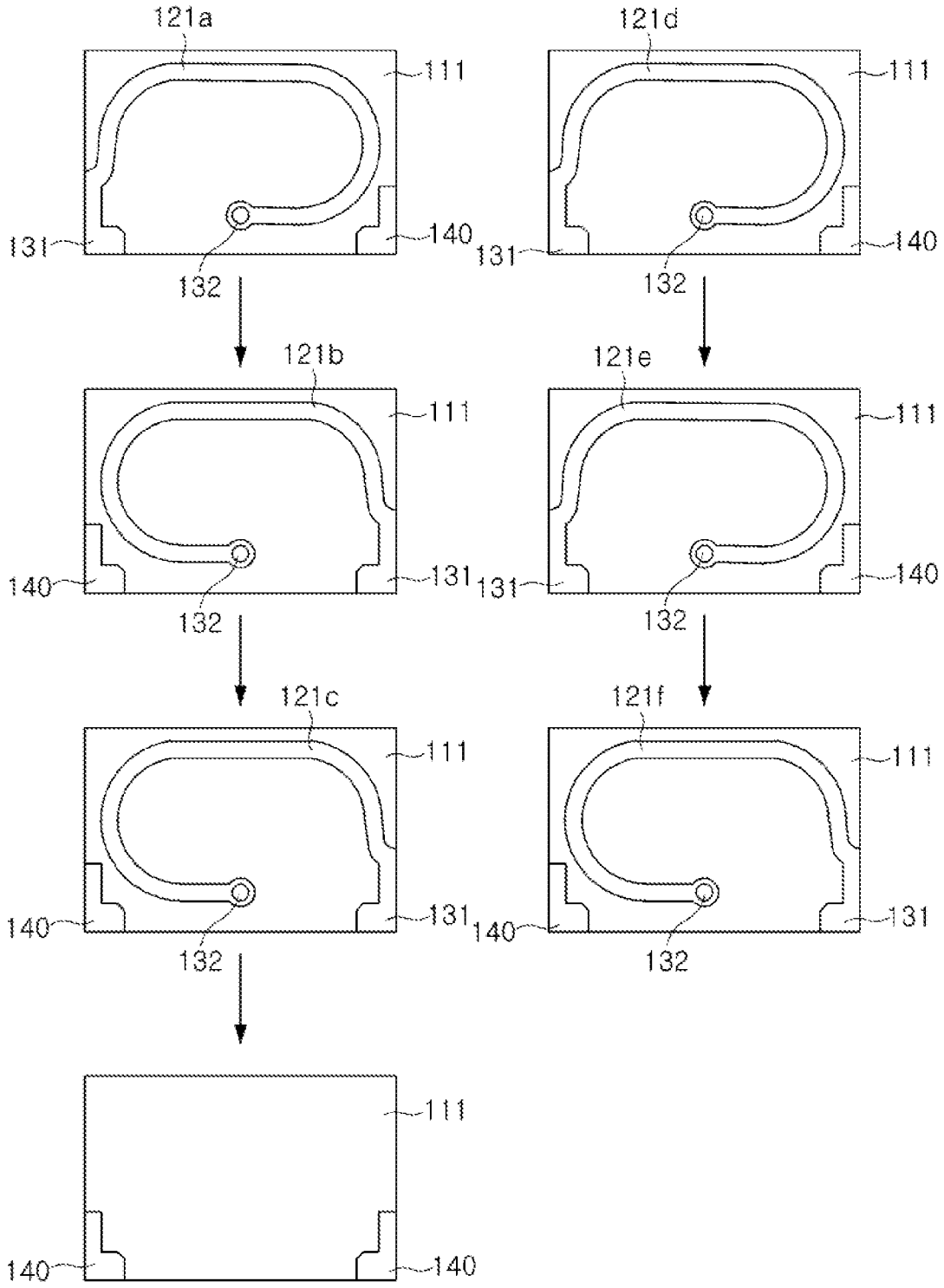
FIG. 4 is a schematic exploded view of an inductor of FIG. 1.

FIG. 4 is a schematic exploded view of an inductor of FIG. 1.

A structure of an inductor 100 according to an exemplary embodiment in the present disclosure will be described with reference to FIGS. 1 through 4.

A body 101 of the inductor 100 according to an exemplary embodiment in the present disclosure may be formed by stacking a plurality of insulating layers 111 in a first direction (e.g., a width direction W denoted in FIG. 1) horizontal to a mounting surface.

The insulating layer 111 may be a magnetic layer or a dielectric layer.

In case where the insulating layer 111 is a dielectric layer, the insulating layer 111 may include $BaTiO_3$ (barium titanate)-based ceramic powder, or the like. In this case, the $BaTiO_3$-based ceramic powder may be, for example, $(Ba_{1-x}Ca_x)TiO_3$, $Ba(Ti_{1-y}Ca_y)O_3$, $(Ba_{1-x}Ca_x)(Ti_{1-y}Zr_y)O_3$, $Ba(Ti_{1-y}Zr_y)O_3$, and the like, prepared by partially employing Ca, Zr, and the like, in $BaTiO_3$, but the present disclosure is not limited thereto.

In case where the insulating layer 111 is a magnetic layer, an appropriate material which may be used as a body of the inductor may be selected as a material of the insulating layer 111, and examples thereof may include resins, ceramics, and ferrite. In this exemplary embodiment, the magnetic layer may use a photosensitive insulating material, whereby a fine pattern may be realized through a photolithography process. That is, by forming the magnetic layer with a photosensitive insulating material, a coil pattern 121, a coil lead portion 131 and a coil connecting portion 132 may be minutely formed to contribute to miniaturization and function improvement of the inductor 100. To this end, the magnetic layer may include, for example, a photosensitive organic material or a photosensitive resin. In addition, the magnetic layer may further include an inorganic component such as $SiO_2/Al_2O_3/BaSO_4$/Talc as a filler component.

First and second external electrodes 181 and 182 may be disposed on an external surface of the body 101.

For example, the first and second external electrodes 181 and 182 may be disposed on a mounting surface of the body 101. The mounting surface refers to a surface facing a printed circuit board (PCB) when the inductor is mounted on the PCB.

The external electrodes 181 and 182 serve to electrically connect the inductor 100 to the PCB when the inductor 100 is mounted on the PCB. The external electrodes 181 and 182 are disposed and spaced apart from each other on the edges of the body 101 in a first direction (e.g., a width direction W denoted in FIG. 1) and in a second direction (e.g., a length direction L denoted in FIG. 1) horizontal to the mounting surface. The external electrodes 181 and 182 may include, for example, a conductive resin layer and a conductive layer formed on the conductive resin layer, but are not limited thereto. The conductive resin layer may include at least one conductive metal selected from the group consisting of copper (Cu), nickel (Ni), and silver (Ag) and a thermosetting resin. The conductive layer may include at least one selected from the group consisting of nickel (Ni), copper (Cu), and tin (Sn). For example, a nickel layer and a tin layer may be sequentially formed.

Referring to FIGS. 1 to 3, a coil pattern 121 may be formed on the insulating layer 111.

The coil pattern 121 may be electrically connected to an adjacent coil pattern 121 by the coil connecting portion 132. That is, the helical coil patterns 121 are connected by the coil connecting portion 132 to form a coil 120. Both ends of the coil 120 are connected to the first and second external electrodes 181 and 182 by the coil lead portion 131, respectively. The coil connecting portion 132 may have a line width larger than the coil pattern 121 to improve connectivity between the coil patterns 121 and include a conductive via penetrating through the insulating layer 111.

The coil lead portion 131 may be exposed to both longitudinal ends (e.g., opposing surfaces in the length direction) of the body 101 and may also be exposed to a lower surface as a board mounting surface. Accordingly, the coil lead portion 131 may have an L-shaped in a cross-section in a length-thickness (L-T) direction of the body 101.

Referring to FIGS. 2 and 3, a dummy electrode 140 may be formed at a position corresponding to the external electrodes 181 and 182 in the insulating layer 111. The dummy electrode 140 may serve to improve adhesion between the external electrodes 181 and 182 and the body 101 or may serve as a bridge when the external electrodes 181 and 182 are formed by plating.

The dummy electrode 140 and the coil lead portion 131 connected to a same one of the external electrodes 181 and 182 may also be connected to each other by a via electrode 142 disposed therebetween in the width direction.

As a material of the coil pattern 121, the coil lead portion 131, and the coil connecting portion 132, a conductive material such as copper (Cu), aluminum (Al), silver (Ag), tin (Sn), gold (Au), nickel (Ni), lead (Pb), or an alloy thereof, having excellent conductivity may be used. The coil pattern 121, the coil lead portion 131, and the coil connecting portion 132 may be formed by a plating method or a printing method, but the present disclosure is not limited thereto.

As illustrated in FIG. 2, the inductor 100 according to the exemplary embodiment in the present disclosure is formed by forming the coil pattern 121, the coil lead portion 131 or the coil connecting portion 132, and the like, on the insulating layers 111 and subsequently stacking the insulating layers 111 in the first direction horizontal to the mounting surface, and thus, the inductor 100 may be manufactured more easily than the related art. In addition, since the coil pattern 121 is disposed to be perpendicular to the mounting surface, magnetic flux may be prevented from being affected by the mounting substrate.

Referring to FIGS. 2 and 3, in the coil 120 of the inductor 100 according to an exemplary embodiment in the present disclosure, when projected in the first direction, the coil patterns 121 overlap each other to form a coil track having one or more coil turns.

Specifically, the first external electrode 181 and a first coil patterns 121*a* are connected by the coil lead portion 131, and thereafter, the first to sixth coil patterns 121*a* to 121*f* are sequentially connected by the coil connecting portion 132.

The second and third coil patterns 121*b* and 121*c* connected in parallel are connected to the second external electrode 182 by the coil lead portion 131, the fourth and fifth coil patterns 121*d* and 121*e* connected in parallel in a different pattern shape are connected to the first external electrode 181 by the coil lead portion 131, and the sixth coil pattern 121*f* is finally connected to the second external electrode 182 by the coil lead portion 131 to form the coil 120.

That is, according to an exemplary embodiment in the present disclosure, the coil patterns 121*b* to 121*e* arranged inside the body 101 are connected in parallel.

Referring to FIG. 3, among the coil patterns, the first coil pattern 121*a* and the sixth coil pattern 121*f* are the outermost coil patterns and the second coil pattern to the fifth coil pattern 121*b* to 121*e* are coil patterns arranged on the inner side.

At least two of the coil patterns connected in parallel and arranged on the inner side are connected in the same pattern.

That is, connection of the coil patterns in parallel refers to a configuration in which two or more adjacent coil patterns, among the coil patterns arranged on the insulating layer 111, have the same shape and connected by the coil connecting portion 132.

The coil patterns 121*b* to 121*e* disposed on the inner side and adjacent to the first coil pattern 121*a* and the sixth coil pattern 121*f*, which are coil patterns arranged on the outermost side, have a pattern shape different from those of the coil patterns 121*a* and 121*f* disposed on the outermost side.

That is, the second coil pattern 121*b* adjacent to the first coil pattern 121*a*, which is the outermost coil pattern, has a pattern shape different from that of the first coil pattern 121*a*.

Similarly, the fifth coil pattern 121*e* adjacent to the sixth coil pattern 121*f*, which is the outermost coil pattern, has a pattern shape different from that of the sixth coil pattern 121*f*.

In the inductor according to an exemplary embodiment in the present disclosure, only the coil patterns arranged on the inner side are connected in parallel, and the coil patterns arranged on the outermost side are not connected in parallel.

Referring to FIG. 3, in the inductor 100 according to an exemplary embodiment in the present disclosure, the plurality of coil patterns 121 include the coil patterns 121*a* and 121*f* disposed on the outermost side and the coil patterns 121*b* to 121*e* disposed on the inner side, and at least one gap G1 among the gaps between the coil patterns 121*b* to 121*e* disposed on the inner side is greater than a gap G2 between the other remaining coil patterns.

As illustrated in FIG. 3, the outermost coil patterns 121*a* and 121*f* refer to the coil patterns disposed to be adjacent to the opposing side surfaces of the body 101 in the stacking direction of the plurality of coil patterns, i.e., in the width direction of the body 101.

In other words, the outermost coil patterns 121*a* and 121*f* do not have an adjacent coil pattern in the direction of the opposing side surfaces of the body 101 and have coil patterns adjacent only in an inward direction.

The coil patterns 121*b* to 121*e* disposed on the inner side of the body 101 refer to the plurality of coil patterns arranged on the inner side of the outermost coil patterns 121*a* and 121*f* disposed to be adjacent to the opposing side surfaces of the body 101 in the width direction of the body 101.

Further, the coil patterns 121*b* to 121*e* arranged on the inner side refer to coil patterns arranged to be adjacent to opposing sides.

In the related art inductor, gaps between the coil patterns are uniform, regardless of position.

In case where the gaps between the coil patterns are uniform, regardless of position, as in the related art, flows of a current are different at positions due to a skin effect and a parasitic effect (or proximity effect) based on an increase of an alternating current (AC) frequency.

As described above, in case where flows of a current are different at positions, the coil patterns have different resistance values at positions.

Such non-uniformity of the resistance values may lower a Q value.

Specifically, in the case of the related art inductor, since the gaps between the coil patterns are formed to be uniform, regardless of position, much current flows to edge portions of the outermost coil patterns due to the parasitic effect and the skin effect and the flows of the current gather outwards.

This phenomenon is due to the fact that a pushing force is generated between two conductors in which current flows in the same direction.

As a result, in the related art inductor, the current does not flow evenly throughout the coil patterns.

That is, an area through which the current passes in the coil patterns arranged on the inner side is relatively small as compared with the coil patterns arranged on the outermost side.

Thus, since the area through which the current passes in the coil patterns arranged on the inner side is reduced, resistance according to the current flow is larger in the coil patterns arranged on the inner side, which resultantly lowers the Q value.

That is, the coil patterns arranged on the inner side may have resistance larger than that of the coil patterns arranged on the external surface.

Thus, it is required to make resistance at positions of the coil patterns uniform by solving the problem that the resistance values are not uniform at positions of the coil patterns due to the non-uniform current flows.

When resistance at positions of the coil patterns is uniform, the Q value may be improved.

In the inductor according to an exemplary embodiment in the present disclosure, at least one gap G1 among the gaps between the coil patterns 121*b* to 121*e* disposed on the inner side is formed to be larger than the gap G2 between the remaining coil patterns 121*b* to 121*e*.

In the inductor according to an exemplary embodiment in the present disclosure, since at least one gap G1 among the gaps between the coil patterns 121*b* to 121*e* disposed on the inner side is larger than the gap G2 between the remaining coil patterns, a resistance value of at least one of the coil patterns 121*b* to 121*e* disposed on the inner side may be lowered and the Q value may be improved.

In other words, it is possible to adjust the resistance values of the coil patterns 121*b* to 121*e* disposed on the inner side and the resistance values of the outermost coil patterns 121*a* and 121*f* to be uniform, resultantly enhancing the Q value.

According to an exemplary embodiment in the present disclosure, the resistance values are adjusted to be uniform at positions of the coil patterns in order to improve the Q value.

In an exemplary embodiment in the present disclosure, the method of making the resistance values uniform by adjusting the at least one gap G1 among the gaps between the coil patterns 121*b* to 121*e* arranged on the inner side to be larger than the gap G2 between the remaining coil patterns may be carried out in various manner and is not limited.

For example, as illustrated in FIG. 4, a dummy insulating layer 111 without a coil pattern may be further inserted into at least one of the coil patterns arranged on the inner side.

In this case, only the insulating layer 111 without a coil pattern may be inserted, or as illustrated in FIG. 4, the insulating layer 111 having the dummy electrode 140 but without a coil pattern may be inserted.

According to an exemplary embodiment in the present disclosure, a larger gap G1 among the gaps between the coil patterns 121*b* to 121*e* disposed on the inner side may be a gap between one of parallelly connected coil patterns 121*b* and 121*c* and another of parallelly connected coil patterns 121*d* and 121*e* adjacent thereto.

Since the larger gap G1 among the gaps between the coil patterns 121*b* to 121*e* disposed on the inner side is disposed between the one of parallelly connected coil patterns 121*b* and 121*c* and another of parallelly connected coil patterns 121*d* and 121*e* adjacent thereto, the excellent effect of enhancing the Q value may be obtained.

Meanwhile, the gaps between the coil patterns 121*b* to 121*e* disposed on the inner side may be increased toward a central portion from the outermost side.

As described above, in general inductors, resistance of the coil pattern disposed on the inner side is larger than that of the coil pattern disposed on the external surface.

Thus, in case where the flows of current are not uniform so resistance values are not uniform at positions of the coil patterns, the Q value is lowered, and thus, in order to solve this problem, it is required to adjust the resistance values at positions of the coil patterns to be uniform.

When the gaps between the coil patterns 121*b* to 121*e* arranged on the inner side are increased toward the central portion from the outermost side, the resistance values at positions of the coil patterns may be more uniform and the enhancement effect of the Q value may be better.

The inductor 100 according to another exemplary embodiment in the present disclosure includes a body 101 in which a plurality of insulating layers 111 on which coil patterns 121 are disposed are stacked and first and second external electrodes 181 and 182 disposed on an external surface of the body 101. The plurality of coil patterns 121 include the outermost coil patterns 121*a* and 121*f* and coil patterns 121*b* and 121*e* disposed on an inner side thereof, the coil patterns 121*b* to 121*e* arranged on the inner side are connected in parallel, and a dummy insulating layer 111 without a coil pattern is further inserted between two of the coil patterns arranged on the inner side.

According to another exemplary embodiment in the present disclosure, since the dummy insulating layer 111 without a coil pattern is further inserted between two of the coil patterns arranged on the inner side, non-uniformity of resistance may be adjusted to enhance a Q value.

In the inductor according to another exemplary embodiment in the present disclosure, a detailed description of the same characteristics as those of the inductor according to the exemplary embodiment in the present disclosure described above will be omitted.

As set forth above, in the inductor according to exemplary embodiments of the present disclosure, the plurality of coil patterns include the coil patterns arranged on the outermost side and the coil patterns arranged on the inner side, the coil patterns arranged on the inner side are connected in parallel, and the at least one gap among the gaps between the coil patterns arranged on the inner side is larger than the gaps between the remaining coil patterns, whereby the Q characteristic of the inductor may be improved.

While exemplary embodiments have been shown and described above, it will be apparent to those skilled in the art that modifications and variations could be made without departing from the scope of the present invention as defined by the appended claims.

What is claimed is:

1. An inductor comprising:

a body in which a plurality of insulating layers on which a plurality of coil patterns are respectively disposed are stacked; and first and second external electrodes disposed on an external surface of the body, wherein a coil includes the plurality of coil patterns connected to each other by coil connecting portions, each of opposing ends of the plurality of coil patterns being connected to one of the first and second external electrodes through a coil lead portion extending between a respective opposing end of the plurality of coil patterns and a respective one of the first and second external electrodes, the plurality of coil patterns include first to sixth coil patterns sequentially arranged, in which the first and sixth coil patterns are respectively as outermost coil patterns of the plurality of coil patterns and respectively connected to the first and second external electrodes, the second and third coil patterns are connected in parallel to the second external electrode, and the fourth and fifth coil patterns are connected in parallel to the first external electrode, and at least one of gaps between adjacent two of the second to fifth coil patterns is greater than a gap between other adjacent two of the second to fifth coil patterns.

2. The inductor of claim 1, wherein pattern shapes of at least two of the second to fifth coil patterns are the same.

3. The inductor of claim 1, wherein the second coil pattern adjacent to the first coil pattern has a pattern shape different from that of the first coil pattern, and the fifth coil pattern adjacent to the sixth coil pattern has a pattern shape different from that of the sixth coil pattern.

4. The inductor of claim 1, wherein the plurality of coil patterns are stacked to be perpendicular to a board mounting surface.

5. The inductor of claim 1, wherein a greater gap among gaps between adjacent two coil patterns of the second to fifth coil patterns is a gap between one of parallelly connected coil patterns and another of parallelly connected coil patterns adjacent thereto, among the second to fifth coil patterns.

6. The inductor of claim 1, wherein gaps between the second to fifth coil patterns increase toward a central portion of the body from the outermost side of the body.

7. The inductor of claim 1, further comprising a dummy electrode disposed on each of the plurality of insulating layers, on which one of the plurality of coil patterns is disposed, wherein the dummy electrode is spaced apart from the plurality of coil patterns and is connected to one of the first and second external electrodes.

8. The inductor of claim 1, further comprising a dummy insulating layer disposed between two of the plurality of insulating layers, wherein among the dummy insulating layer and the plurality of insulating layers, the coil connecting portions respectively penetrate only in the plurality of insulating layers.

9. An inductor comprising:

a body in which a plurality of insulating layers on which a plurality of coil patterns are respectively disposed are stacked; and first and second external electrodes disposed on an external surface of the body, wherein a coil includes the plurality of coil patterns connected to each other by coil connecting portions, each of opposing ends of the plurality of coil patterns being connected to one of the first and second external electrodes through a coil lead portion extending between a respective opposing end of the plurality of coil patterns and a respective one of the first and second external electrodes, the plurality of coil patterns include first coil patterns respectively as outermost coil patterns of the plurality of coil patterns, and second coil patterns disposed between the first coil patterns, the second coil patterns are connected in parallel, a dummy insulating layer without a coil pattern is disposed between two of the second coil patterns, first and second dummy electrodes are disposed on the dummy insulating layer and are connected to the first and second external electrodes, respectively, and among the dummy insulating layer and the plurality of insulating layers, the coil connecting portions respectively penetrate only in the plurality of insulating layers.

10. The inductor of claim 9, wherein pattern shapes of at least two of the second coil patterns connected in parallel are the same.

11. The inductor of claim 9, wherein the second coil patterns adjacent to the first coil patterns have a pattern shape different from that of the first coil patterns.

12. The inductor of claim 9, wherein the plurality of coil patterns are stacked to be perpendicular to a board mounting surface.

13. The inductor of claim 9, wherein at least one gap among gaps between the second coil patterns is larger than gaps between other remaining second coil patterns.

14. The inductor of claim 13, wherein a greater gap among gaps between the second coil patterns is a gap between one of parallelly connected second coil patterns and another of parallelly connected second coil patterns adjacent thereto.

15. The inductor of claim 13, wherein gaps between the second coil patterns increase toward a central portion of the body from the outermost side of the body.

16. The inductor of claim 9, further comprising a dummy electrode disposed on each of the plurality of insulating layers, on which one of the plurality of coil patterns is disposed, wherein the dummy electrode is spaced apart from the plurality of coil patterns and is connected to one of the first and second external electrodes.

17. An inductor comprising:

a body in which a plurality of insulating layers on which a plurality of coil patterns are respectively disposed are stacked, the body including a dummy insulating layer disposed between two of the plurality of insulating layers; and first and second external electrodes disposed on an external surface of the body, wherein a coil includes the plurality of coil patterns connected to each other by coil connecting portions, opposing ends of the plurality of coil patterns are connected to the first and second external electrodes through coil lead portions, respectively, the plurality of coil patterns include first coil patterns respectively as outermost coil patterns of the plurality of coil patterns, and second coil patterns disposed between the first coil patterns, the second coil patterns are connected in parallel, among the dummy insulating layer and the plurality of insulating layers, the coil connecting portions respectively penetrate only in the plurality of insulating layers, and first and second dummy electrodes are disposed on the dummy insulating layer and are connected to the first and second external electrodes, respectively.

18. The inductor of claim 17, wherein one of gaps between the second coil patterns is greater than a gap between other remaining second coil patterns.

19. The inductor of claim 17, further comprising a dummy electrode disposed on each of the plurality of insulating layers, on which one of the plurality of coil patterns is disposed, wherein the dummy electrode is spaced apart from the plurality of coil patterns and is connected to one of the first and second external electrodes.

* * * * *